US005686938A

United States Patent [19]

Batkhan

[11] Patent Number: 5,686,938

[45] Date of Patent: Nov. 11, 1997

[54] ADAPTIVE CURSOR CONTROL SYSTEM

[76] Inventor: Leonid Z. Batkhan, 12304 Village Square Ter., #402, Rockville, Md. 20852

[21] Appl. No.: 496,526

[22] Filed: Jun. 29, 1995

[51] Int. Cl.[6] ..... G09G 5/08

[52] U.S. Cl. ..... 345/145; 345/157

[58] Field of Search ..... 345/145, 156, 345/157, 158, 159, 160; 128/630, 731, 732, 687, 689, 905; 364/413.02, 413.03; 348/2, 61; 482/89, 900, 901, 902

[56] References Cited

U.S. PATENT DOCUMENTS

| | | | |
|---|---|---|---|
| 4,217,642 | 8/1980 | Dam et al. . | |
| 4,228,430 | 10/1980 | Iwamura et al. . | |
| 4,467,322 | 8/1984 | Bell et al. . | |
| 4,683,891 | 8/1987 | Cornellier et al. | 128/687 |
| 4,894,777 | 1/1990 | Negishi et al. | 364/413.02 |
| 5,185,597 | 2/1993 | Pappas et al. . | |
| 5,287,119 | 2/1994 | Drumm . | |
| 5,359,347 | 10/1994 | Kim et al. . | |
| 5,376,949 | 12/1994 | Haigh et al. . | |
| 5,389,947 | 2/1995 | Wood et al. . | |
| 5,447,166 | 9/1995 | Gevins | 128/731 |
| 5,465,729 | 11/1995 | Bittman et al. | 128/732 |
| 5,527,239 | 6/1996 | Abbondanza | 482/902 |

*Primary Examiner*—Steven Saras
*Attorney, Agent, or Firm*—Myers Liniak & Berenato

[57] ABSTRACT

A cursor control system and method of implementing same is provided for adjusting the cursor blinking frequency so that the cursor blinks on the display screen at a frequency which i a function (linear or non-linear) of a measured physical condition (e.g. pulse rate) of the user. For example, the cursor frequency may be adjusted so that the cursor blinks on the display screen at a rate or frequency corresponding to the measured pulse rate of the user.

16 Claims, 5 Drawing Sheets

ADAPTIVE CURSOR CONTROL SYSTEM

This invention relates to a system and corresponding method for controlling the blinking frequency of a cursor shown on a computer display screen. More particularly, this invention relates to a system and method for adjusting the cursor blinking frequency on a computer display screen in response to a measured physical condition (e.g. pulse rate) of the user.

BACKGROUND OF THE INVENTION

The use of cursors on a computer display screen is old and well-known throughout the art. See U.S. Pat. Nos. 4,228,340; 5,389,947; 5,376,949; 5,359,347; and 5,185,597. For example, U.S. Pat. No. 5,389,947 discloses a graphic subsystem in which highlighted pixels in a cursor are displayed by inverting the output of a color palette RAM at cursor locations by way of, for example, an exclusive-OR function of the color palette RAM. Inversion of the output of the color palette RAM results in higher contrast pixels within the cursor as will be appreciated by those of skill in the art.

It is also old and well-known throughout the art to design a cursor system for use in combination with a computer display where the actual cursor shown on the display screen blinks at a predetermined constant frequency.

For example, in Microsoft WINDOWS™ Version 3.1, the cursor blink rate or frequency may be preset as follows. As shown in FIG. 1, the computer user, from the Program Manager Window, clicks on the Main icon using a typical mouse or the like. When the Main window opens, the user then clicks on the Control Panel icon. Then, after the Control Panel window opens, the user clicks on the Desktop icon. When the Desktop window opens, a cursor blink rate area 2 is illustrated in the bottom right corner of the Desktop window. Then, using the mouse, for example, the computer screen user may move the sliding button in the cursor blink rate area to the left or to the right so as to provide slower or faster cursor blinking respectively. Additionally, a demo cursor 4 is located in the right side of the Desktop window so that the user can actually view the cursor blinking rate or frequency as shown on the screen.

In sum, in the WINDOWS™ 3.1 system shown in prior art FIG. 1, the user is able to adjust the cursor blink rate to his liking. However, in order to adjust the cursor blink rate, the user must go through the above-set-forth process which is both time consuming and burdensome, and, once the cursor blink rate is set to a predetermined frequency, it cannot be thereafter changed or adjusted unless the computer user again accesses the Desktop icon in the above set forth manner.

Unfortunately, the constant blink rate or cursor blinking frequency of WINDOWS™ 3.1 as described above does not reflect the physiological condition of the user, which varies over time. Because work at a computer terminal or adjacent a computer display screen is often an emotional process, the user's physiological condition may vary over time while working on the display screen via the cursor. For example, the user's physical or physiological condition may be a function of the time of day, the user's degree of tiredness or sleepiness, excitement, health condition, etc. Thus, at times, the preset constant cursor blinking rate or frequency of FIG. 1 sometimes becomes undesirably fast or slow for the user thereby leading to discomfort, stress, and/or fatigue. This, of course, slows down the effectiveness of the user's work.

In view of the above, there is a need in the art for a system and corresponding method for automatically adjusting the cursor blinking rate or cursor blinking frequency of a cursor shown on a display screen so that it corresponds to or is a function of the physiological condition of the user.

It is a purpose of this invention to fulfill the above-described needs in the art, as well as other needs apparent to the skilled artisan from the following detailed description of this invention.

SUMMARY OF THE INVENTION

Generally speaking, this invention fulfills the above-described needs in the art by providing a method of adjusting the blinking frequency of a cursor on a computer display screen, the method comprising the steps of:

a) providing a computer display screen having a cursor displayed thereon, the cursor blinking at a blinking frequency;

b) measuring the pulse rate of a user of the display screen;

c) forwarding data indicative of the measured pulse rate of the user to the computer; and d) adjusting the cursor blinking frequency in response to the measured pulse rate.

This invention further fulfills the above-described needs in the art by providing a cursor control system for controlling the blinking frequency of a cursor on a computer display screen, the system comprising:

a display screen;

a cursor displayed on the display screen and blinking at a cursor blinking frequency;

a pulse measuring device for measuring the pulse rate of a user of the display screen; and means for adjusting the cursor blinking frequency in accordance with the measured pulse rate of the user so that the frequency at which the cursor blinks on the display screen is a function of the measured pulse rate of the user.

This invention further fulfills the above-described needs in the art by providing a method of adjusting the blinking frequency of a cursor on a computer display screen so that the displayed cursor blinks at a frequency which is a function of a physical condition of the user, the method comprising the steps of:

a) providing a computer display screen having the cursor displayed thereon, the cursor blinking at a blinking frequency;

b) measuring a physical condition of the user; and c) adjusting the cursor blinking frequency in response to the measured pulse rate so that the cursor blinks on the screen at a frequency which is a function of the measured physical condition of the user.

According to certain preferred embodiments of this invention, the physical condition of the user is one of: the pulse rate of the user, the blood pressure of the user, the temperature of the user, the electrical conductivity or resistance of the user's skin, and the breathing frequency of the user.

IN THE DRAWINGS

Figure 4:
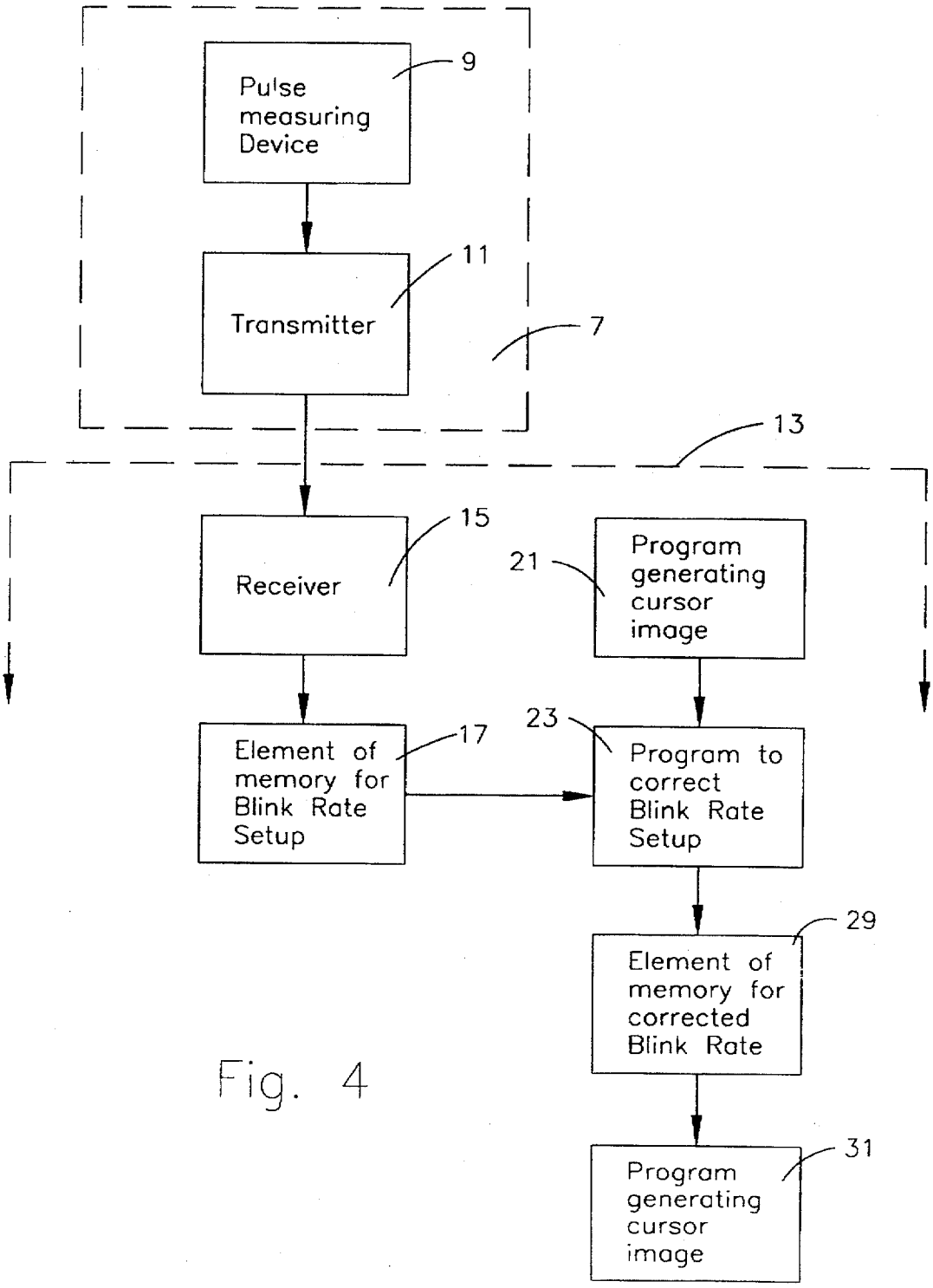
FIG. 4 is a block diagram/flowchart illustrating steps and componentry making up a system according to a second embodiment of this invention.
Figure 5A:
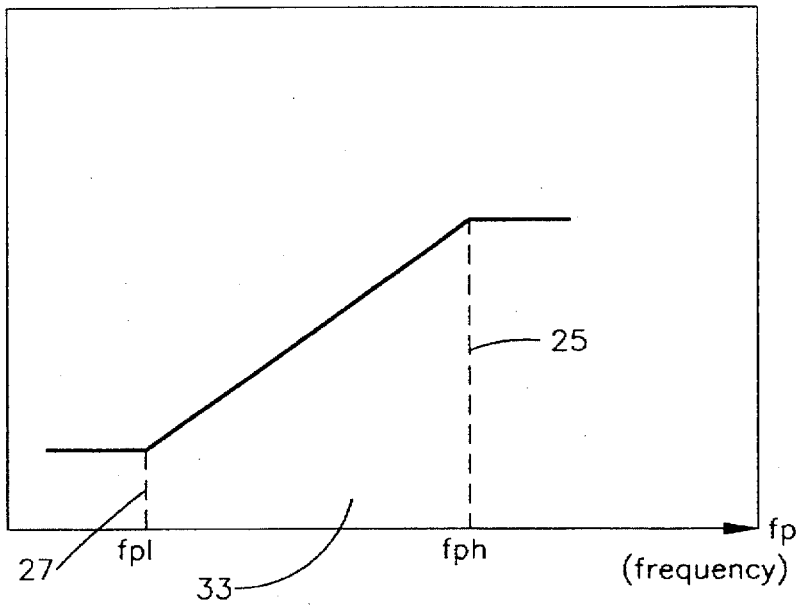
Figure 5B:
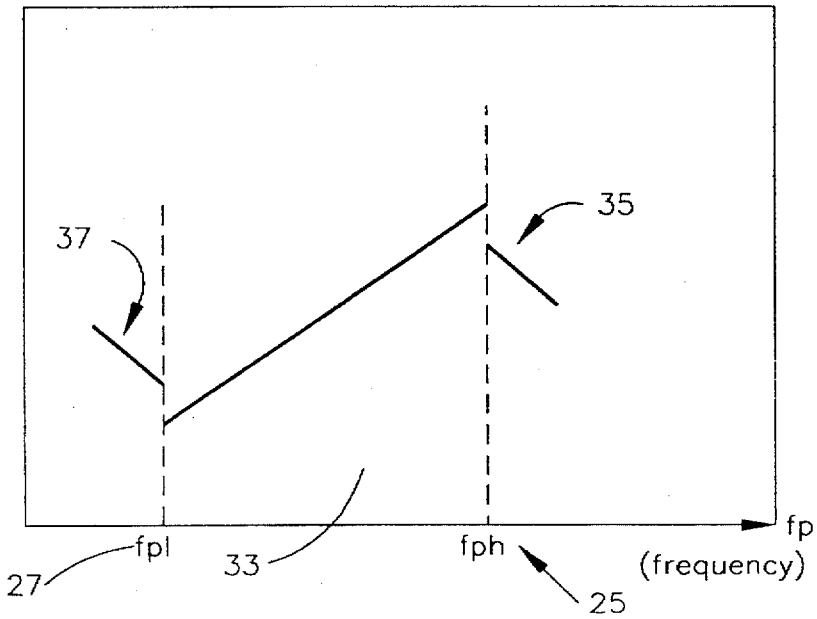

FIGS. 5(*a*) and 5(*b*) are graphs of alternative implementations illustrating upper and lower pulse rate limits defining comfort zones in accordance with the second or FIG. 4 embodiment of this invention.

DETAILED DESCRIPTION OF CERTAIN EMBODIMENTS OF THIS INVENTION

Referring now more particularly to the accompanying drawings in which like reference numerals indicate like parts throughout the several views.

Figure 1:
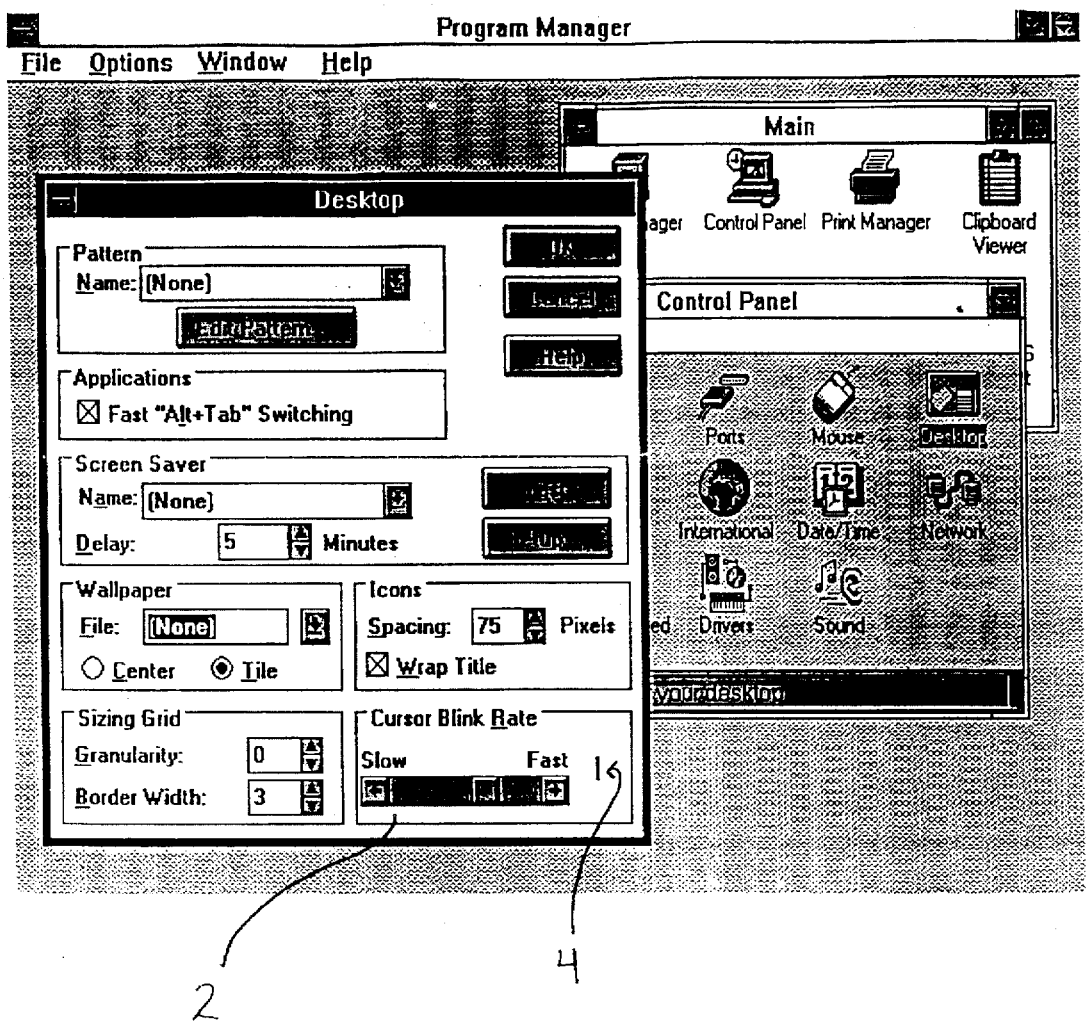
FIG. 1 (PRIOR ART)
FIG. 1 is an illustration of a prior art display screen providing the capability of adjusting the cursor blinking frequency.
Figure 2:
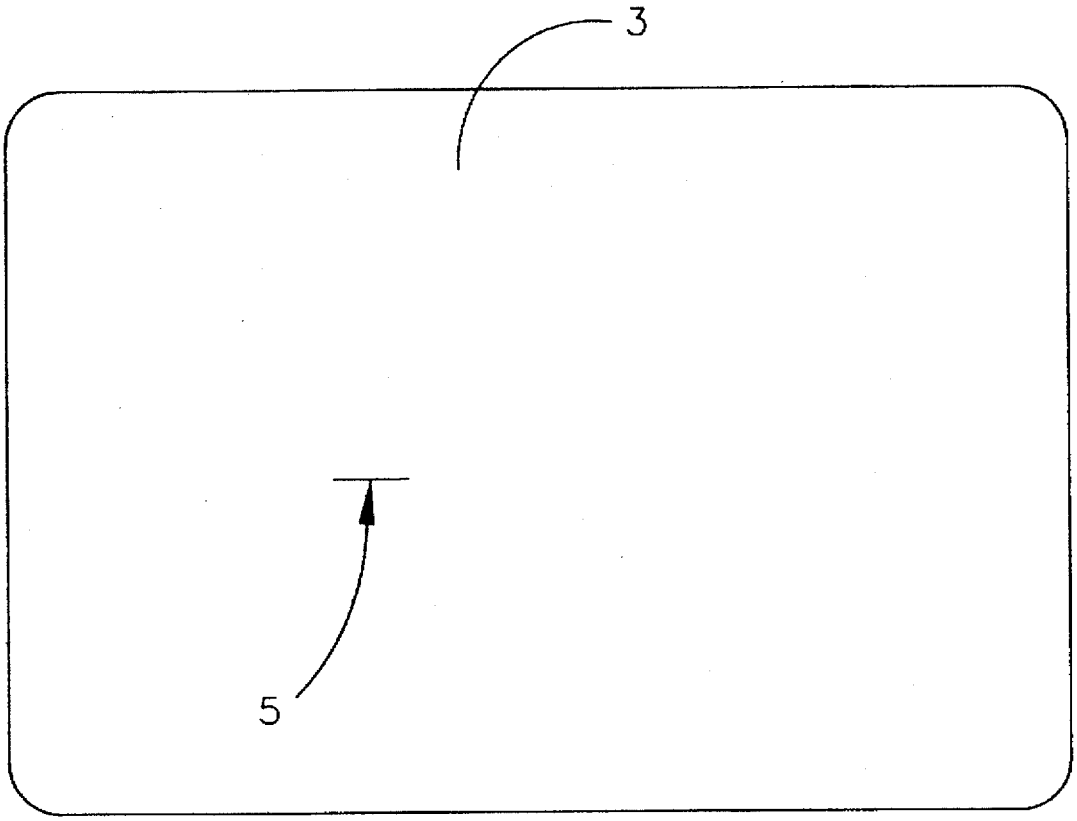
FIG. 2 is a side elevational view of a computer display screen having a cursor shown thereon according to an embodiment of this invention.

FIG. 2 is a side elevational view of computer display screen 3 having cursor 5 portrayed thereon. Cursor 5 blinks at a blinking frequency which is determined as a function of a measured physical condition (e.g. pulse rate, temperature, blood pressure, etc.) of the computer screen user as will be discussed below. Display screen 3 may be of the CRT, liquid crystal display, or any other conventional type. Cursor 5, of course, may be in the shape of a horizontal bar, a vertical bar, an I-beam, a "+", or any other conventional cursor design known to those in the trade.

Figure 3:
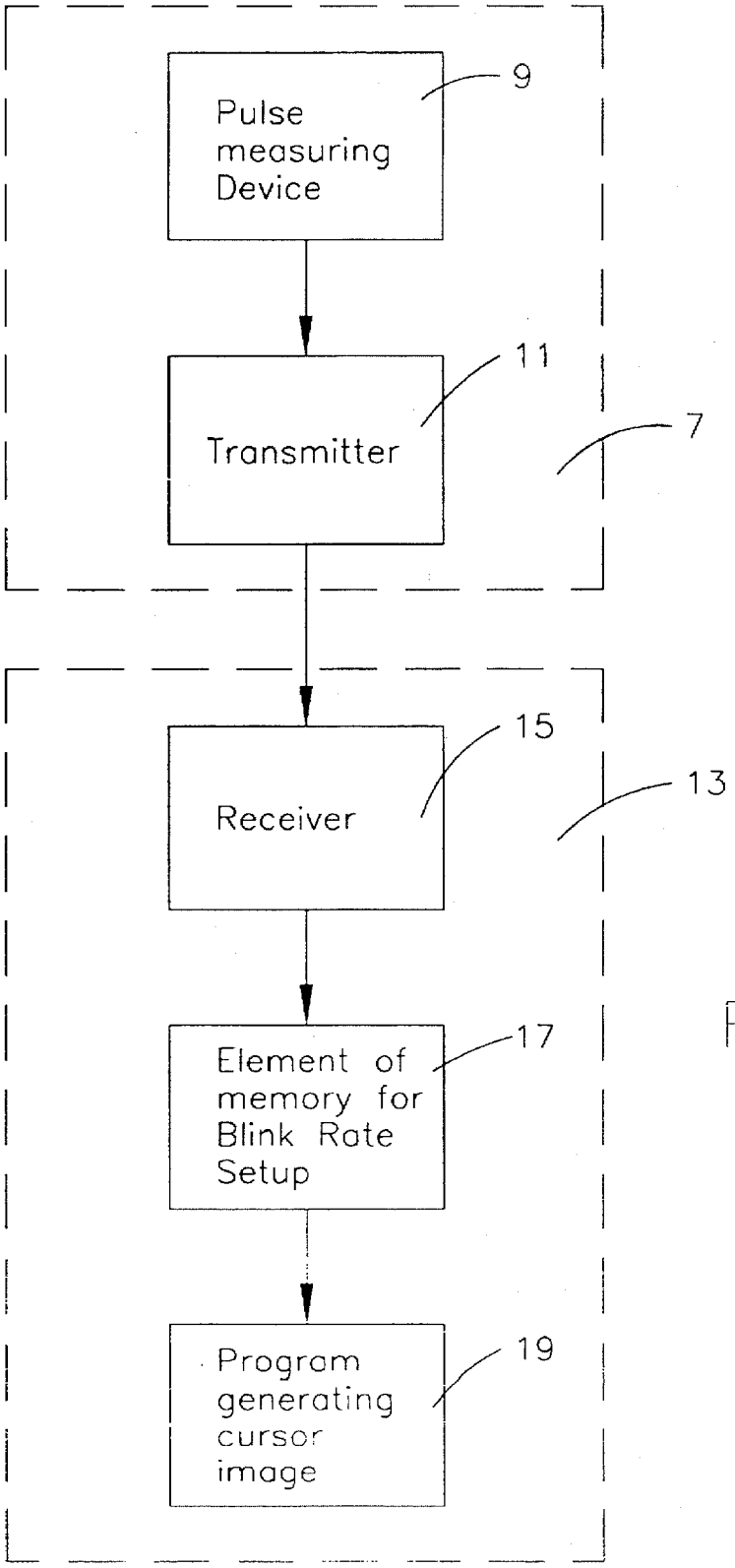
FIG. 3 is a block diagram/flowchart illustrating steps and componentry making up the system according to a first embodiment of this invention.

FIG. 3 is a block diagram/flowchart of a system and corresponding method of adjusting the blinking frequency of cursor 5 on screen 3 according to a first embodiment of this invention. This first embodiment may be termed a "match mode" in that the cursor blinking frequency which controls the blinking rate of cursor 5 on screen 3 is adjusted so as to substantially correspond or substantially match the measured pulse rate of computer screen user 7. A conventional pulse rate measuring device 9 and transmitter 11 are provided at user 7.

Pulse rate measuring device 9 measures the pulse rate of the user by way of any known method while transmitter 11 receives the measured pulse rate data from device 9 and forwards it to computer 13. Transmitter 11 may be of the wireless type so that it transmits pulse rate data signals to computer 13 by way of RF signals, optical (e.g. infrared) signals, microwave signals, ultrasound signals, or any other conventional method. Alternatively, transmitter 11 may forward the measured pulse rate data signals to computer 13 by way of a conventional wire, cord, or optical fiber connection.

Receiver 15 within computer 13 receives the measured pulse rate data signals from transmitter 11 and forwards them to memory element 17. From memory element 17, the pulse rate measured data is forwarded to program 19 which generates the image of cursor 5 on display screen 3 at the blinking frequency which is a function of the measured pulse rate. Program 19 uses the measured pulse rate data from user 7 (which was measured by device 9) as the basis for adjusting the cursor blinking frequency. In other words, the measured pulse frequency of user 7 controls the frequency of cursor image generator 19 so that it corresponds to or is a function of the pulse rate of the user at any given moment. Thus, adaptive feedback is established and the blinking frequency of cursor 5 becomes dependent upon the pulse rate of the user. This makes the computer user feel comfortable in viewing screen 3 and using cursor 5 whatever the user's physiological condition. Accordingly, the blinking frequency of cursor 5 is a direct function of the user pulse rate measured by device 9.

According to certain embodiments, the blinking frequency $f_c$ of cursor 5 substantially matches the measured pulse rate of the user so that the cursor blinking frequency $f_c$ increases along with the measured pulse rate $f_p$. According to certain other embodiments of this invention, the blinking frequency $f_c$ of cursor 5 is a linear function of the user pulse rate $f_p$, but is offset with respect thereto. In sum, the cursor blinking frequency control system as shown in FIG. 3 provides an ergonomically suitable dynamic cursor image 5 and creates a biologically active connection between user 7 and computer 13 via cursor 5. This secures the psychological comfort for the user as a result of the user feeling that the computer adapts to his physical or physiological condition. The benefits of this are reduced drowsiness and improved health and efficiency of users. Such a system may be manufactured as a kit including pulse rate measuring device 9, transmitter 11, receiver 15, and software or hardware making up elements 17 and 19.

FIG. 4 is a block diagram and flowchart illustrating a system and corresponding method for adjusting the blinking frequency of cursor 5 on screen 3 according to a second embodiment of this invention. This second embodiment shown in FIG. 4 may be termed an "active mode" which uses different functional dependencies between the measured pulse rate $f_p$ and the cursor blinking rate or frequency $f_c$. FIGS. 5(*a*) and 5(*b*) are graphs illustrating upper and lower pulse rate limits (defining a comfort zone 33 for the user) which may be set and used according to the second embodiment of this invention.

The second embodiment includes pulse measuring device 9 which may be, for example, a conventional pulse measuring device adapted to be attached to the wrist of a user. The system further includes transmitter 11 preferably disposed at the user location 7. Computer 13 according to the second embodiment includes receiver 15, memory element 17, program (or equivalent hardware) 21 for presetting pulse rate points of correction (i.e. upper and lower pulse rate limits 25 and 27), program (or equivalent hardware) 23 for correcting the blink rate set up for the cursor 5 as a function of upper pulse rate limit 25 and lower pulse rate limit 27 (see FIGS. 5(*a*) and 5(*b*)), memory element 29 for storing the corrected cursor blinking rate or frequency, and program (or equivalent hardware) 31 for generating the image of cursor 5 on computer display screen 3.

FIGS. 5(*a*) and 5(*b*) are graphs illustrating upper pulse rate limit or pulse rate frequency 25 ($f_{ph}$) and lower pulse rate limit 27 ($f_{pl}$) which may be set by the user by way of program 21 according to the second embodiment of this invention. FIGS. 5(*a*) and 5(*b*) plot the user's pulse rate frequency $f_p$ along the horizontal or X-axis and the cursor blinking frequency ($f_c$) along the vertical or Y-axis. Thus, as shown, between lower pulse rate limit 27 and upper pulse rate limit 25, in comfort zone 33, the cursor blinking rate or frequency $f_c$ varies as a function of the measured pulse rate $f_p$. According to certain embodiments of this invention, the cursor blinking frequency $f_c$ varies in a substantially linear manner as a function of $f_p$ in zone 33, with the cursor blinking frequency $f_c$ increasing (faster blinking) so as to correspond linearly with increases in the measured pulse rate $f_p$ between the upper and lower pulse rate limits according to the second embodiment of this invention.

According to certain alternative embodiments of this invention, programs (or hardware implemented units) 23 and 31 may be adjusted so that the cursor blinking frequency $f_c$ varies in a substantially non-linear manner with respect to the measured user pulse rate $f_p$ between the upper and lower pulse rate limits $f_{ph}$ and $f_{pl}$ respectively.

FIGS. 5(*a*) and 5(*b*) illustrate two different approaches which may be employed according to the second or FIG. 4 embodiment of this invention. The first approach is illustrated in FIG. 5(*a*) where the cursor blinking frequency $f_c$ varies in a substantially linear manner as a function of $f_p$ between the upper and lower pulse rate limits 25 and 27 which are set by program 21, with the cursor blinking frequency $f_c$ becoming substantially constant outside of the boundary or window defined between limits 25 and 27. As shown, the cursor blinking frequency $f_c$ increases substantially linearly as a function of the measured pulse rate up to the point where the measured pulse rate reaches upper limit 25. After the measured pulse rate reaches upper limit 25, the cursor blinking frequency $f_c$ no longer increases with increases in $f_p$, but becomes substantially constant with such $f_p$ increases after the value reached at limit 25. Likewise, the cursor blinking frequency $f_c$ is substantially constant below lower limit 27 at values corresponding to and below its value determined at lower limit 27.

Thus, upper limit 25 and lower limit 27 for pulse rate $f_p$ define comfort range 33 therebetween. $f_c$ will not follow $f_p$ after it exits comfort zone or range 33, but rather $f_c$ remains substantially constant leading to or attempting to stabilize the user's pulse rate $f_p$. Comfort levels 25 and 27 (i.e. the upper and lower pulse rate set by program 21) may be set to, for example a desired range.

FIG. 5(*b*) is a graph illustrating another alternative way in which to implement the system according to the second or FIG. 4 embodiment of this invention. As shown in FIG. 5(*b*), after the measured pulse rate $f_p$ leaves comfort zone or range 33, the cursor blinking frequency $f_c$ changes by a leap or step (the size of the leap may be 0 or any positive or negative number) thereby not stabilizing $f_p$, but rather attempting to invert the measured user's pulse rate's directionality. In other words, if the user's pulse rate $f_p$ is increasing, when it reaches upper limit 25 as shown in FIG. 5(*b*), the cursor blinking frequency will drop a step as shown at 35 so as to attempt to make the user's pulse rate $f_p$ start to move downward or decrease (as opposed to keep rising). Likewise, if the user's measured pulse rate $f_p$ is dropping, when it reaches lower limit 27, the blinking frequency of the cursor $f_c$ leaps upwardly by a step as illustrated at 37 in an attempt to make the user's pulse rate begin to rise (increase) instead of continuing to drop.

According to certain other embodiments of this invention, when the measured pulse rate $f_p$ of the user exits comfort zone 33, the color or shape of cursor 5 may be changed by program or hardware 31 so as to indicate to the user that the user's pulse rate is outside of comfort zone 33. Additionally, a warning signal or message may be portrayed on display screen 3 when the measured pulse rate $f_p$ of the user is not within comfort zone 33. For example, this message may inform the user to rest, see a doctor, or to take known precautions so as to prevent undue stress or the like.

It is to be understood that the cursor blinking frequency according to the above-described embodiments of this invention may be adjusted as a function of physical conditions of the user other than the measured pulse rate. For example, the cursor blinking frequency $f_c$ may be adjusted in comfort zone 33 as a function of the measured blood pressure of the user, the measured temperature of the user, the measured breathing frequency of the user, the measured electrical conductivity or resistance of the user's skin, or any other known physical (or mental) condition of the user which may be measured by conventional methods. Device 9 would, of course, be used to take such measurements. The cursor blinking frequency $f_c$ may be adjusted in a substantially linear or a substantially non-linear manner so as to correspond to or be offset from these measured user physical conditions.

Once given the above disclosure, many other features, modifications, and improvements will become apparent to the skilled artisan. Such other features, modifications, and improvements are therefore considered to be a part of this invention, the scope of which is to be determined by the following claims.

I claim:

1. A method of adjusting the blinking frequency of a cursor on a computer display screen, the method comprising the steps of:

a) providing a computer display screen having a cursor displayed thereon, the cursor blinking at a blinking frequency;

b) measuring the pulse rate of a user of the display screen;

c) forwarding data indicative of the measured pulse rate of the user to the computer; and d) adjusting the cursor blinking frequency in response to the measured pulse rate.

2. The method of claim 1, further comprising the step of adjusting the cursor blinking frequency so that it substantially matches the measured pulse rate of the user.

3. The method of claim 1, further comprising the steps of:

defining a lower limit pulse rate and an upper limit pulse rate;

in step d) adjusting the cursor blinking frequency so that it substantially corresponds with the measured pulse rate when the measured pulse rate is between the defined upper and lower pulse rate limits; and adjusting the cursor blinking frequency so that it does not substantially correspond to the measured pulse rate when the measured pulse rate is not between the defined upper and lower pulse rate limits.

4. The method of claim 3, further comprising the step of setting the cursor blinking frequency to a substantially constant value when the measured pulse rate is not between the defined upper and lower pulse rate limits.

5. The method of claim 3, further comprising the step of issuing a warning signal to the user when the measured pulse rate is not between the defined upper and lower pulse rate limits.

6. The method of claim 1, further comprising the step of in step d) adjusting the cursor blinking frequency so that the cursor always blinks on the display screen at a frequency substantially corresponding to the measured user pulse rate.

7. The method of claim 1, further comprising the step of in step c) forwarding the measured pulse rate of the user to the computer in a wireless manner.

8. A cursor control system for controlling the blinking frequency of a cursor on a computer display screen, the system comprising:

a display screen;

a cursor displayed on said display screen and blinking at a cursor blinking frequency;

a pulse measuring device for measuring the pulse rate of a user of said display screen; and means for adjusting the cursor blinking frequency in accordance with the measured pulse rate of the user so that the frequency at which the cursor blinks on the display screen is a function of the measured pulse rate of the user.

9. The control system of claim 8, further comprising means for setting a minimum pulse rate limit and a maximum pulse rate limit, and wherein said means for adjusting adjusts the cursor blinking frequency in a first manner when the measured pulse rate is between said minimum and maximum pulse rate limits and in a second manner when the measured pulse rate is not between said minimum and maximum pulse rate limits, said first and second manners being different.

10. The control system of claim 9, wherein said first manner is defined as adjusting the blinking frequency so that it substantially corresponds to the measured pulse rate.

11. The control system of claim 9, wherein said second manner is defined as setting the blinking frequency to a substantially constant value as long as the measured pulse rate is not between said minimum and maximum pulse rate limits.

12. The control system of claim 8, wherein said means for adjusting adjusts the blinking frequency so that the cursor on the display screen blinks at a frequency substantially corresponding to the measured pulse rate.

13. The control system of claim 8, wherein said pulse measuring device transmits measured pulse rate data to the computer by way of a wireless transmission.

14. A method of adjusting the blinking frequency of a cursor on a computer display screen so that the displayed cursor blinks at a frequency which is a function of a physical condition of the user, the method comprising the steps of:

a) providing a computer display screen having the cursor displayed thereon, the cursor blinking at a blinking frequency;

b) measuring a physical or mental condition of the user; and c) adjusting the cursor blinking frequency in response to the measured pulse rate so that the cursor blinks on the screen at a frequency which is a function of the measured physical or mental condition of the user.

15. The method of claim 14, wherein the condition of the user is one of: the pulse rate of the user, the blood pressure of the user, temperature of the user, electrical conductivity or resistance of the user's skin, and the breathing frequency of the user.

16. The method of claim 14, wherein in step c) the cursor blinking frequency is adjusted so that the cursor blinks on the screen at a frequency substantially corresponding to the measured user condition.

* * * * *